343-909 SR
7/13/82 XR 4,339,757

United States Patent [19]
Chu

[11] 4,339,757
[45] Jul. 13, 1982

[54] BROADBAND ASTIGMATIC FEED ARRANGEMENT FOR AN ANTENNA

[75] Inventor: Ta-Shing Chu, Lincroft, N.J.

[73] Assignee: Bell Telephone Laboratories, Incorporated, Murray Hill, N.J.

[21] Appl. No.: 209,943

[22] Filed: Nov. 24, 1980

[51] Int. Cl.[3] ..... H01Q 19/13
[52] U.S. Cl. ..... 343/781 P; 343/781 CA; 343/909
[58] Field of Search ..... 343/753, 755, 781 P, 343/781 CA, 909

[56] References Cited

U.S. PATENT DOCUMENTS

| | | | |
|---|---|---|---|
| 3,146,451 | 8/1964 | Sternberg | 343/753 |
| 3,569,975 | 3/1971 | Fretz | 343/781 |
| 3,688,311 | 8/1972 | Salmon | 343/755 |
| 3,737,909 | 6/1973 | Bartlett et al. | 343/755 |
| 3,792,480 | 2/1974 | Graham | 343/781 |
| 3,821,746 | 6/1974 | Mizusawa et al. | 343/781 |
| 3,828,352 | 8/1974 | Drabowitch et al. | 343/837 |
| 3,922,682 | 11/1975 | Hyde | 343/761 |
| 3,995,275 | 11/1976 | Betsudan et al. | 343/781 |
| 4,145,695 | 3/1979 | Gans | 343/779 |
| 4,224,626 | 9/1980 | Sternberg | 343/911 |

OTHER PUBLICATIONS

Ohm & Gans, Numerical Analysis of Multiple-Beam Offset Cassegrainian Antennas, AIAA Paper No. 76-301, Apr. 1976.

*Primary Examiner*—Eli Lieberman
*Attorney, Agent, or Firm*—Erwin W. Pfeifle

[57] ABSTRACT

The present invention relates to an antenna arrangement capable of correcting for astigmatism over a broadband range, the antenna arrangement comprising a main focusing reflector arrangement (10), such as, for example, a Cassegrain antenna system, a feed (12) and astigmatic correction means (14) disposed between the feed and the main focusing antenna arrangement. The astimatic correction means comprises a first and a second doubly curved subreflector (16, 18) or lens (30, 32) which are curved in orthogonal planes to permit the launching of an astigmatic beam of constant size and shape over a broadband range.

6 Claims, 7 Drawing Figures

BROADBAND ASTIGMATIC FEED ARRANGEMENT FOR AN ANTENNA

BACKGROUND OF THE INVENTION

1. Field of the Invention

The present invention related to a broadband astigmatic feed arrangement for an antenna and, more particularly, to a broadband astigmatic feed arrangement comprising a first and a second doubly curved subreflector which are curved in orthogonal planes to permit the launching of an astigmatic beam of constant size and shape over a broadband frequency range. For special cases, either the first or the second subreflector can comprise the shape of a section of a cylinder.

2. Description of the Prior Art

Except for possibly the axial beam of a paraboloidal antenna, reflectors generally will suffer from some sort of aberration if the feedhorn must be located away from the geometrical focus so that a reflected planar wavefront is not produced. This is especially true in a multibeam reflector antenna system. Antenna systems, however, have been previously devised to correct for certain aberrations which have been found to exist.

U.S. Pat. No. 3,146,451 issued to R. L. Sternberg on Aug. 25, 1964 relates to a microwave dielectric lens for focusing microwave energy emanating from a plurality of off-axis focal points into respective collimated beams angularly oriented relative to the lens axis. In this regard also see U.S. Pat. No. 3,737,909 issued to H. E. Bartlett et al on June 5, 1973.

U.S. Pat. No. 3,569,795 issued to G. C. Fretz, Jr. on Mar. 9, 1971 relates to apparatus for altering an electromagnetic wave phase configuration to a predetermined nonplanar front to compensate for radome phase distortion and which wave, upon exiting the radome, has a phase front which is planar.

Other antenna system arrangements are known which use subreflectors and the positioning of feedhorns to compensate for aberrations normally produced by such antenna systems. In this regard see, for instance U.S. Pat. Nos. 3,688,311 issued to J. Salmon on Aug. 29, 1972; 3,792,480 issued to R. Graham on Feb. 12, 1974; and 3,821,746 issued to M. Mizusawa et al on June 28, 1974.

U.S. Pat. No. 3,828,352 issued to S. Drabowitch et al on Aug. 6, 1974 relates to microwave antennas including a toroidal reflector designed to reduce spherical aberrations. The patented antenna structure comprises a first and a second toroidal reflector centered on a common axis of rotation, each reflector having a surface which is concave toward that common axis and has a vertex located in a common equatorial plane perpendicular thereto.

U.S. Pat. No. 3,922,682 issued to G. Hyde on Nov. 25, 1975 relates to an aberration correcting subreflector for a toroidal reflector antenna. More particularly, an aberration correcting subreflector has a specific shape which depends on the specific geometry of the main toroidal reflector. The actual design is achieved by computing points for the surface of the subreflector such that all rays focus at a single point and that all pathlengths from a reference plane to the point of focus are constant and equal to a desired reference pathlength. The Hyde subreflector, however, (a) only corrects for on-axis aberration of the torus (similar to spherical aberration), (b) only compensates for aberrations when positioned in the far field of the feed, and (c) can be used to produce offset beams in only one plane.

U.S. Pat. No. 4,145,695 issued to M. J. Gans on Mar. 20, 1979 relates to launcher reflectors which are used with reflector antenna systems to compensate for the dominant aberration of astigmatism which was found to be introduced in the signals being radiated and/or received at the off-axis positions. A major portion of such phase error is corrected by using, with each off-axis feedhorn, an astigmatic launcher reflector having a curvature and orientation of its two orthogonal principal planes of curvature which are chosen in accordance with specific relationships, the launcher reflector being fed by a symmetrical feedhorn.

Prior art arrangements, however, have only compensated for astigmatism introduced by off-axis position of a reflector over a certain band of frequencies. The problem, therefore, remaining is to provide feed arrangements for the correction of astigmatism in off-axis fed reflector antennas over a broad band of frequencies.

SUMMARY OF THE INVENTION

The foregoing problem has been solved in accordance with the present invention which relates to a broadband astigmatic feed arrangement for an antenna and, more particularly, to a broadband astigmatic feed arrangement comprising a first and a second doubly curved subreflector which are each curved in orthogonal planes to permit the launching of an astigmatic beam of constant size and shape over a broadband frequency range. For special cases, either the first or the second subreflector can comprise the shape of a section of a cylinder.

It is an aspect of the present invention to provide a broadband antenna system capable of correcting for astigmatism in a beam which is launched or received by the antenna system. The antenna system comprises a main focusing reflector and a feed arrangement including a feed capable of launching or receiving a beam of electromagnetic energy and an astigmatic correcting means. Th astigmatic correcting means comprises a first reflector disposed between the feed and the main focusing reflector along the feed axis of the antenna system for said beam, the first reflector comprising different focal lengths in each of two orthogonal planes equal to $1/f_1 = 1/L'_1 + 1/L'_i$ and a radius of curvature according to the relationships $R\perp = 2f_1(\perp) \cos \Theta_i$, and $$R_{\parallel} = \frac{2f_1(\parallel)}{\cos\theta_i}$$

where $f_1$ is the focal length in each of the two orthogonal planes, $L'_1$ in the distance between the center of the first reflector and the center of the feed aperture distribution, $L'_i$ is the distance between the center of the first reflector and the center of an intermediate image of the feed formed by the first reflector, $R\parallel$ is the radius of curvature of said first reflector in the plane of incidence of said beam, $R\perp$ is the radius of curvature of said first reflector perpendicular to the plane of incidence, and $\Theta_i$ is the angle of incidence of the beam; and a second reflector disposed between the first reflector and the main focusing reflector along the feed axis of the antenna system for said beam, the second reflector comprising different focal lengths in each of two orthogonal planes equal to $1/f_2 = 1/L_i + 1/L_i$ and a radius of curvature according to the relationships $R\perp=2f_2(\perp)\cos\Theta_i$, and $$R_{\parallel}=\frac{2f_2(\parallel)}{\cos\theta_i}$$

where $f_2$ is the focal length in each of the two orthogonal planes, $L_1$ is the distance from the center of said second reflector to the center of a next reflector along the feed axis of the antenna system forming a part of the main focusing reflector, and $L_i$ is the distance between the center of the second reflector and said intermediate image of the feed formed by the first reflector, the first and second reflectors being spaced apart a distance, l, as determined from the relationship $$l=\frac{L'_1}{h}\left[\frac{L_1}{r_1}-1\right]-hL_1\left(1+\frac{L'_1}{r'_1}\right)$$

where $h=L'_1/L'_i\cdot L_i/L_1$, $r'_1$ is the radius of curvature of the phase distribution at the aperture of the feed, and $r_1$ is the radius of curvature of the phase distribution at a final image of the feed formed at said next reflector along the feed axis of the antenna system forming a part of the main focusing reflector.

Other and further aspects of the present invention will become apparent during the course of the following description and by reference to the accompanying drawings.

BRIEF DESCRIPTION OF THE DRAWINGS

Referring now to the drawings, in which like numerals represent like parts in the several views.

DETAILED DESCRIPTION

Figure 1:
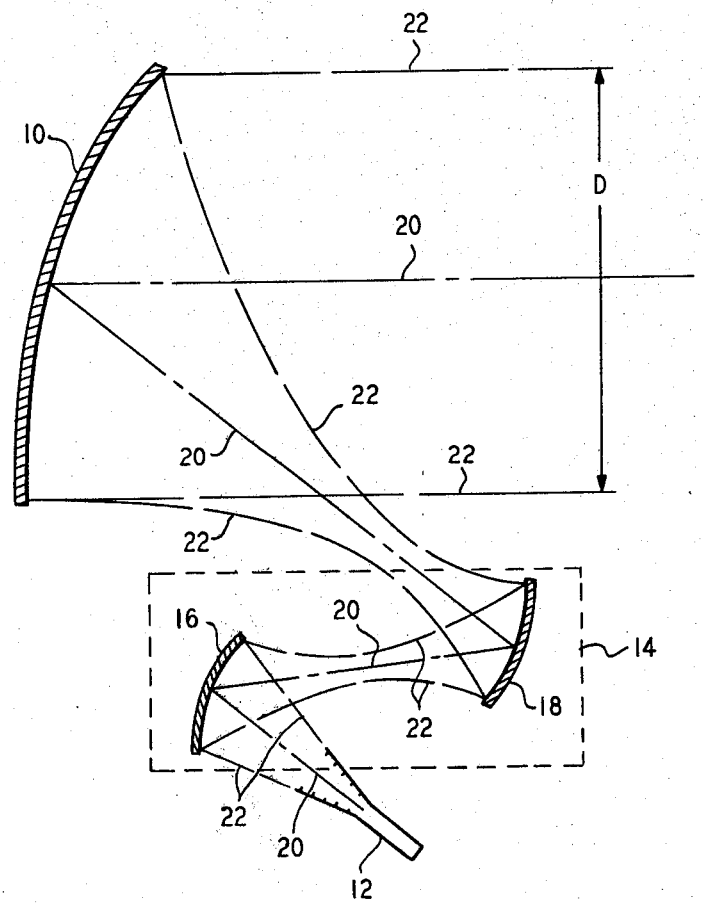
FIG. 1 illustrates an antenna comprising a main reflector, a feedhorn and astigmatic correcting means formed in accordance with the present invention.

FIG. 1 illustrates an offset reflector antenna in accordance with the present invention which comprises a main focusing reflector 10 having an aperture of size D, a corrugated feedhorn 12 and a broadband astigmatic correction means 14 comprising a first doubly curved subreflector 16 and a second doubly curved subreflector 18 formed in a manner to be described hereinafter. It is to be understood that the antenna may further include additional subreflectors (not shown), not forming a part of broadband astigmatic corrections means 14, which are disposed between correction means 14 and main reflector 10 along a feed axis 20 of the antenna. Feed axis 20 can also be realized as the central ray of a beam 22 either radiated by feedhorn 12 to aperture D of main reflector 10 or received at aperture D and reflected to feedhorn 12 via main reflector 10 and subreflectors 16 and 18 of astigmatic correction means 14.

For purposes of an analytical description of the present invention which is provided hereinafter, alternative astigmatic thin lenses will be used for approximating astigmatic subreflectors 16 and 18 of correction means 14 of FIG. 1. In such analysis, a corrugated horn aperture field can be transformed into an astigmatic gaussian beam by frequency-independent imaging process. It should be noted that the frequency insensitive property of a corrugated horn aperture field is desired for the broadband astigmatic compensation. However, neither the constant beamwidth approximation nor the constant phase center approximation will be assumed in the broadband corrugated feedhorn 12 in the hereinafter analysis.

Figure 2:
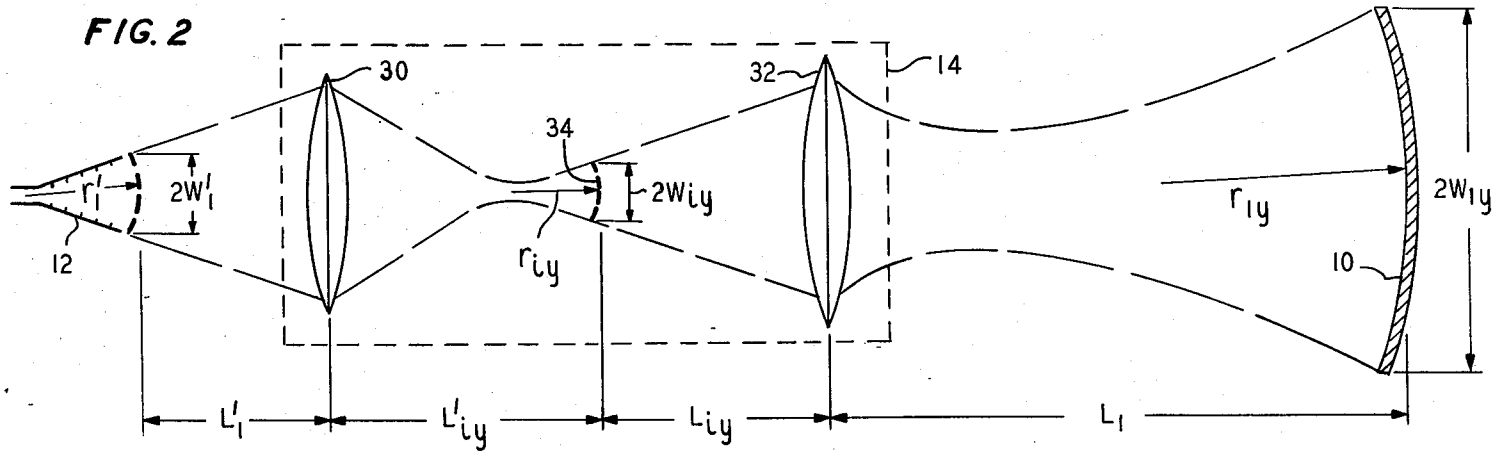
FIG. 2 illustrates an arrangement of two astigmatic lenses corresponding to the two astigmatic reflectors of FIG. 1 with a beam in the y plane.
Figure 3:
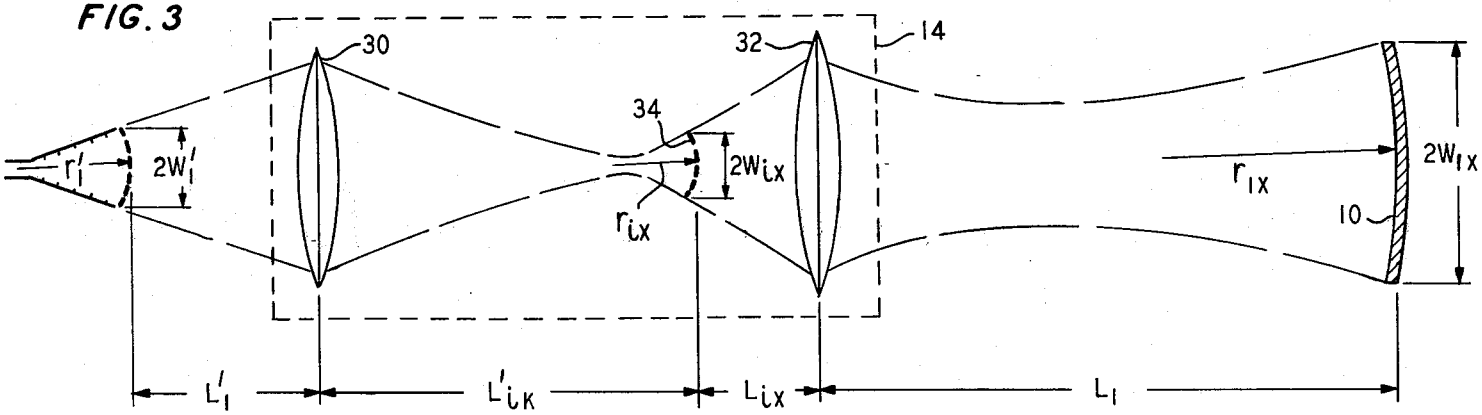
FIG. 3 illustrates an arrangement corresponding to FIG. 2 with a beam in the x plane.

The parameters for a combination of two astigmatic lenses which will perform frequency-independent matching between an astigmatic gaussian field distribution and a circularly symmetric gaussian field distribution will now be derived. Since the gaussian beam function is separable in cartesian coordinates of x and y, the corresponding matching conditions can be given respectively for each principal plane provided the principal axes of the lens astigmatism are also aligned with x and y. However, the matching conditions are coupled by the same lens locations for both x and y planes. Matching between circularly symmetric and astigmatic gaussian beams through two astigmatic lenses is shown in FIGS. 2 and 3 for the y and x planes, respectively. In the arrangements of FIGS. 2 and 3, a corrugated feedhorn 12 radiates a circular symmetric beam through a first astigmatic lens 30, corresponding to subreflector 16 of FIG. 1, and a second astigmatic lens 32, corresponding to subreflector 18 of FIG. 1.

Figure 4:
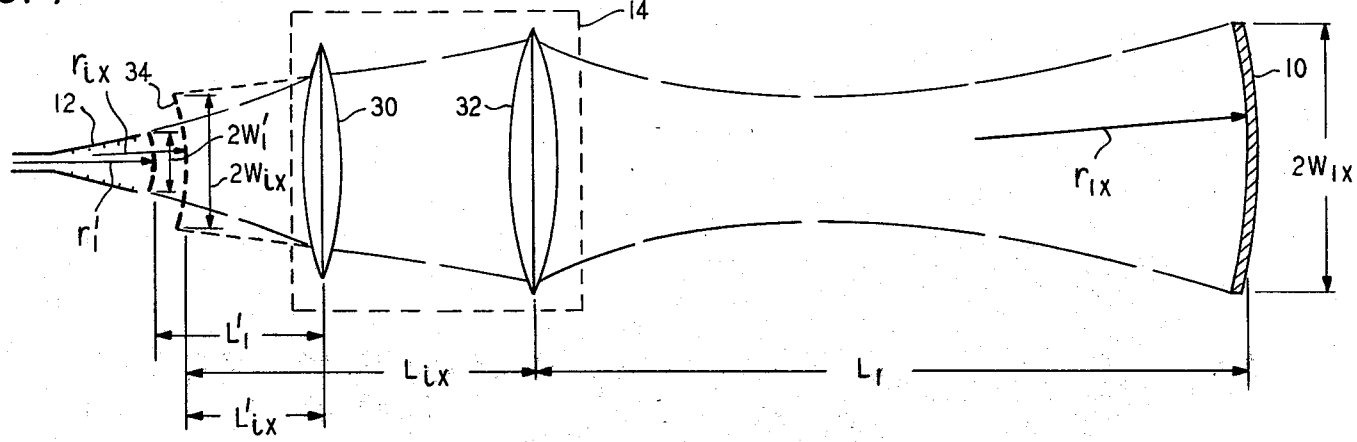
FIG. 4 illustrates an arrangement of FIG. 3 with a virtual intermediate image of the feedhorn formed on the left side of lens 30 in the x plane.
Figure 5:
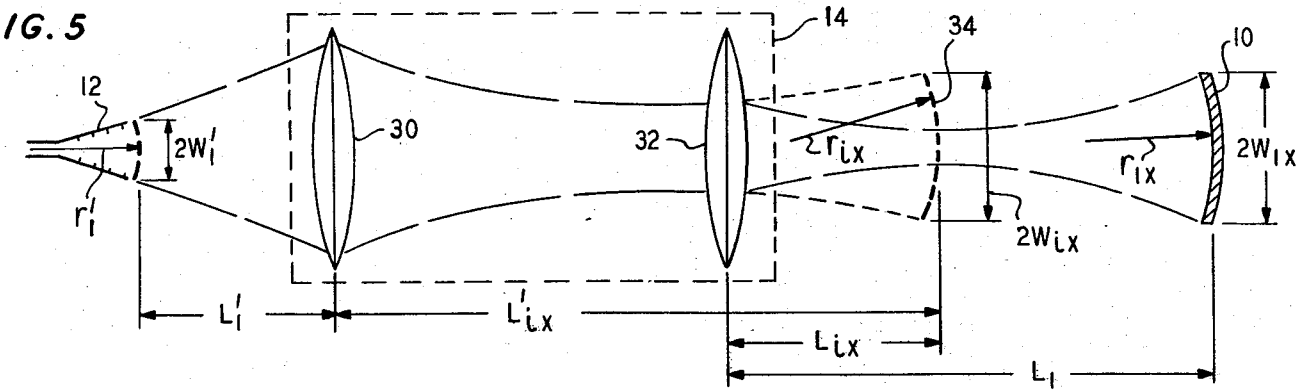
FIG. 5 illustrates an arrangement of FIG. 3 with a virtual intermediate image of the feedhorn formed by lens 30 on the right side of lens 32 in the x plane.

Frequency independent matching by lens is essentially an imaging process. In each principal plane an intermediate image is formed by the first lens, and then imaged by the second lens into the required field distribution. This intermediate image can be either real or virtual. In FIG. 2, $L'_i$ is negative if an intermediate virtual image is on the left side of lens 30 as shown in FIG. 4, whereas $L_i$ is negative if an intermediate virtual image is on the right hand side of lens 32 as shown in FIG. 5. The term $L'_i$ is the distance between the center of lens 30 and the center of an intermediate image 34 of the feedhorn 12 formed by lens 30, and $L_i$ is the distance between the center of lens 32 and the intermediate image 34 of the feedhorn formed by lens 30 in each of the x and y plane.

For analyzing the general case, the radius of curvature $r_{ix}$ of the image phase distribution in the x plane can be expressed in terms of the radius of curvature $r'_1$ of the object phase distribution in the x plane as $$\frac{1}{r_{ix}}=\frac{1}{L'_{ix}}\left[1+\frac{L'_1}{L'_{ix}}\left(1+\frac{L'_1}{r'_1}\right)\right] \quad (1)$$

The corresponding equation for the second lens 32 in the x plane is $$\frac{1}{r_{1x}} = \frac{1}{L_1}\left[1 + \frac{L_{ix}}{L_1}\left(1 + \frac{L_{ix}}{r_{ix}}\right)\right] \quad (2)$$

It is to be understood that a negative sign would be placed after the equals sign in both Equations (1) and (2) if the radius of curvature of $r_i$ and $r_1$ were opposite to each other in direction.

From FIGS. 2–4, one can use the identity $$L'_{ix} = \frac{(L'_{ix} + L_{ix})\frac{L'_1}{L_1}}{h_x + L'_1/L_1} \quad (3)$$

where $$h_x = \frac{L'_1}{L'_{ix}} \cdot \frac{L_{ix}}{L_1} \quad (4)$$

has the magnitude of the ratio between beam radii $$|h_x| = \frac{W'_1}{W_{ix}} \frac{W_{ix}}{W_{1x}} = \frac{W'_1}{W_{1x}} \quad (5)$$

The sign of $h_x$ depends upon the signs of distances $L'_{ix}$ and $L_{ix}$. Substituting Equations (1) and (3) into Equation (2) and using $l = L'_{ix} + L_{ix}$ yields the lens spacing $$l = \frac{L'_1}{h_x}\left[\frac{L_1}{r_{1x}} - 1\right] - h_x L_1\left(1 + \frac{L'_1}{r'_1}\right) \quad (6)$$

Similarly for the same lens spacing $l = L'_{iy} + L_{iy}$ in the y-plane $$l = \frac{L'_1}{h_y}\left[\frac{L_1}{r_{1y}} - 1\right] - h_y L_1\left(1 + \frac{L'_1}{r'_1}\right) \quad (7)$$

where $$h_y = \frac{L'_1}{L'_{iy}} \frac{L_{iy}}{L_1} \text{ and } |h_y| = \frac{W'_1}{W_{1y}} \quad (8)$$

Combining Equations (5) and (6) gives an expression for $L'_1$ $$L'_1 = \frac{(h_x - h_y)L_1}{\frac{\left(\frac{L_1}{r_{1x}} - 1\right)}{h_x} - \frac{h_x L_1}{r'_1} - \frac{\left(\frac{L_1}{r_{1y}} - 1\right)}{h_y} + \frac{h_y L_1}{r'_1}} \quad (9)$$

For any given distance $L_1$ between the second lens 32 and the required astigmatic gaussian field illumination as shown in FIGS. 2 and 3, Equation (9) together with Equation (7) or (6) specify the lens locations for frequency independent matching between a circularly symmetric gaussian field and the astigmatic gaussian field.

To satisfy the imaging condition, the focal lengths of the first and second lens 30 and 32, respectively, in the x-plane are respectively $$1/f_{Ix} = 1/L'_1 + 1/L'_{ix} \quad (10)$$

$$1/f_{IIx} = 1/L_{ix} + 1/L_1 \quad (11)$$

whereas those in the y-plane are simply obtained by substituting the subscript y for x in Equations (10) and (11).

To minimize the truncation effect, the lens diameter must be at least three (preferrably four) times the beam radius at the lens location. The beam radius, $W'_2$, at the first lens 30 is given by $$W_2' = W_1'\sqrt{\left(-\frac{L'_1}{r'_1} - 1\right) + \left(\frac{L'_1\lambda}{\pi W'^2_1}\right)^2} \quad (12)$$

where $\lambda$ is the wavelength. The beam radii, $W_{2x}$ or $W_{2y}$, at the second lens 32 for x and y planes are respectively $$W_{2x} = W_{1x}\sqrt{\left(\frac{L_1}{r_1} - 1\right)^2 + \left(\frac{L_1\lambda}{\pi W_{1x}^2}\right)^2} \quad (13)$$

and $$W_{2y} = W_{1y}\sqrt{\left(\frac{L_1}{r_{1y}} - 1\right)^2 + \left(\frac{L_1\lambda}{\pi W_{1y}^2}\right)^2} \quad (14)$$

The sign difference between equations (13) and (12) is due to the providing of curvatures $r_{1x}$ and $r_{1y}$ with a positive sign when concave toward the left in FIGS. 2 or 3.

Figure 6:
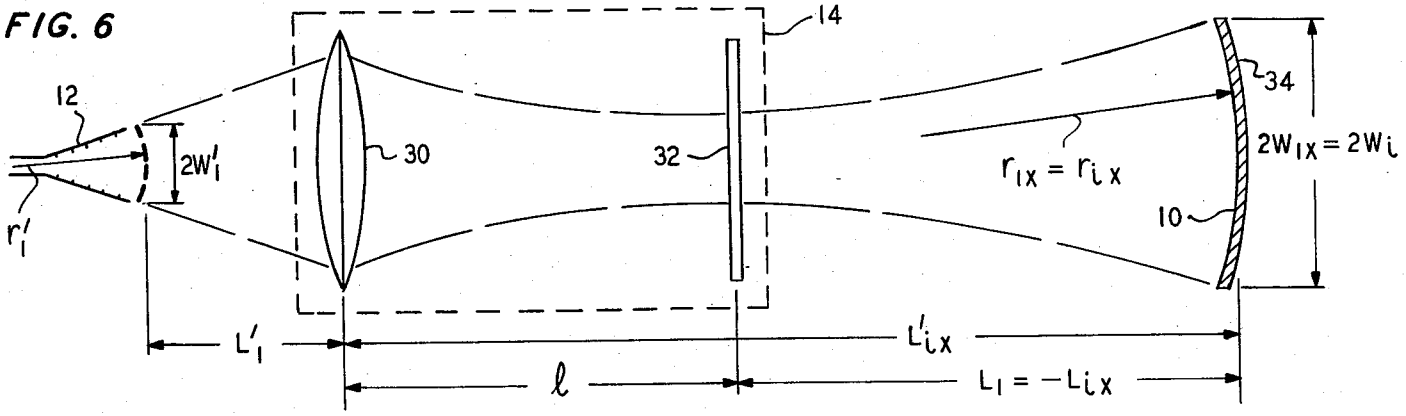
FIG. 6 illustrates an arrangement of FIG. 3 where the virtual intermediate image coincides with the final image of the feedhorn in the x plane to permit the use of a cylindrical lens which have a flat radius of curvature in the x plane.

When the (virtual) intermediate image 34 in one principal phase, as for example the x plane, becomes coincident as shown in FIG. 6 with the final image, which is the required astigmatic gaussian field distribution, an important special case is obtained in which the second astigmatic lens 32 is a cylindrical lens. Here the virtual intermediates image 34 is simply imaged onto itself.

If the second lens is flat in the x-plane, it will have no effect on the image formation in that plane. Then for this special case, the distance $L'_{ix} = l + L_1$ from the first lens 30 to the final image 10 is just determined by imaging of the first lens 30 alone, or $$\frac{r_{1x}}{L'_{ix}}\left[1 + \frac{L'_1}{L'_{ix}}\left(1 + \frac{L'_1}{r'_1}\right)\right] = 1 \quad (15)$$

where l is the distance between astigmatic lenses 30 and 32. Now the ratio between beam radii in this plane will be simply $$W'_1/W_{1x} = L'_1/L'_{ix}. \quad (16)$$

Therefore combining Equations (15) and (16) gives $$L'_{ix} = \frac{r_{1x}\left(1 + \frac{W'_1}{W_{1x}}\right)}{1 - \left(\frac{W'_1}{W_{1x}}\right)^2 \frac{r_{1x}}{r'_1}} \quad (17)$$

To find the location of the cylindrical lens, one can substitute Equation (7) into $L'_{ix}=1+L_1$, and find $$L_1 = \frac{L'_{ix} + L'_{1/hy}}{1 + \frac{L'_1}{h_y r_{1y}} - h_y\left(1 + \frac{L'_1}{r'_1}\right)} \quad (18)$$

where $h_y$ is positive when both $L'_{iy}$ and $L_{iy}$ in equation (8) is positive. The intermediate image 34 in the y plane is real for this case and Equations (17) and (18) constitute the solution of the lens locations for this special case in which the lens 32 in FIG. 3 or 6 is cylindrical. The lens size requirements can be estimated by Equations (12) through (14) and it can be noted that the price for using a cylindrical lens is the restriction by Equation (18) in the choice of $L_1$.

Figure 7:
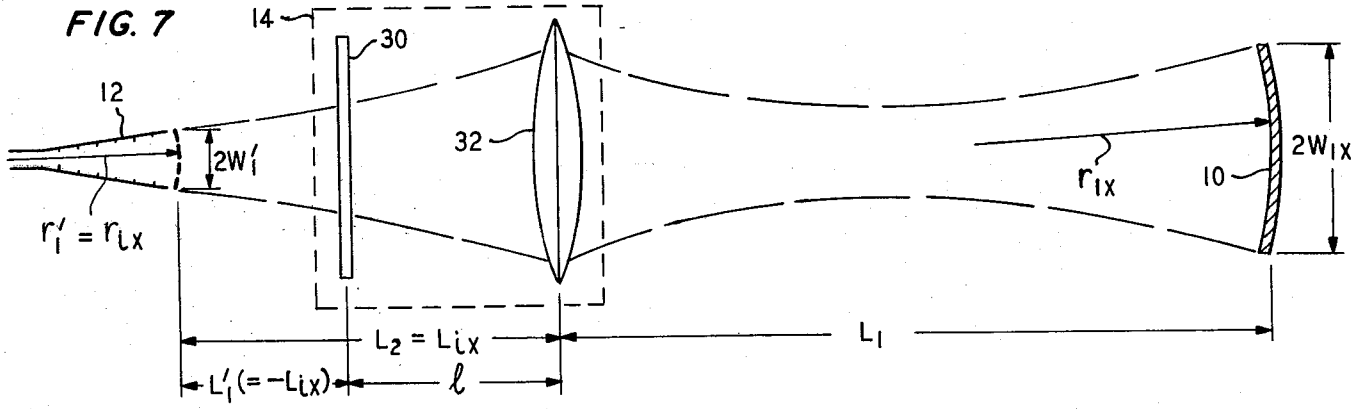
FIG. 7 illustrates an arrangement of FIG. 3 where the virtual intermediate image of the feedhorn coincides with the feedhorn aperture in the x plane to permit the use of a cylindrical lens which has a flat radius of curvature in the x plane.

When the virtual intermediate image 34 in one principal phase becomes coincident, as shown in FIG. 7, with the feedhorn 12 distribution, another special case is obtained in which the first astigmatic lens 30 nearest to the feedhorn, is a cylindrical lens. Here the feedhorn gaussian beam 10 in one principal plane is imaged onto itself.

Since the first lens 30 is flat, for example, in x-plane, it will have no effect in that plane. Then the distance $L_2=L'_1+l$ from the feedhorn aperture to the second lens 32 is just determined by imaging of the second lens 32 alone, and $$\frac{r_{1x}}{L_1}\left[1 + \frac{L_2}{L_1}\left(1 + \frac{L_2}{r'_1}\right)\right] = 1 \quad (19)$$

The ratio between beam radii in this case is simply $$W'_1/W_{1x}=L_2/L_1 \quad (20)$$

Combining Equations (19) and (20) gives $$L_2 = \frac{r_{1x}\left(1 + \frac{W'_1}{W_{1x}}\right)}{\frac{W_{1x}}{W'_1} - \frac{r_{1x}W'_1}{r'_1 W_{1x}}} \quad (21)$$

To find the location of the cylindrical lens 30, one can substitute $l=L_2-L'_1$ into Equation (7) and find $$L'_1 = \frac{L_2 + h_y L_1}{1 + \frac{L_1}{h_y r_{1y}} - \frac{1}{h_y}\left[1 + \frac{h_y^2 L_1}{r'_1}\right]} \quad (22)$$

where $h_y$ is negative when $L'_{iy}$ in Equation (8) is negative. In this case the virtual intermediate image 34 in the y plane is also on the left side of astigmatic lens 30.

The lens locations can be certainly varied by changing the beam radius $w'_1$ and the phase front radius of curvature $r'_1$ of the corrugated circular feedhorn 12, which is limited by economy considerations. It is also obvious that the above equations can be solved for $w'_1$ and $r'_1$ with given lens 30 and 32 locations.

If a lens is approximately realized by an offset reflector as shown in FIG. 1, within paraxial ray approximation, the following equation of the reflector is $$z = \frac{x^2}{2R_\perp} + \frac{y^2}{2R_\parallel} + ey^3 \quad (23)$$

where $e = = \frac{e^2\sin(\theta_p = \theta_i)\cos(\theta_p = \theta_i)}{L_0\sin\theta_p}\left(\frac{1}{2R_\perp}\right)$, e is the eccentricity of the ellipse which is equivalent to the lens with the object focus at a distance $L_0$ in the plane of incidence, $\Theta_i$ is the angle of incidence, $\Theta_p$ is the angle between the control ray and the line connecting the image and object focii in the plane of incidence, z is the distance from the tangent plane at the intersection of the center ray and the reflector, and x and y are the corresponding cartesian transverse coordinates. $R\perp$ and $R\parallel$ are radii of curvature in the principal planes perpendicular and parallel to the plane of incidence. A positive radius indicates concave curvature towards the illuminated side. Let $\Theta_i$ denote the angle of incidence between the center ray 20 and the z-axis, one obtains the following relations between the reflector radii of curvature and the astigmatic lens focal lengths $$R\perp=2f_x\cos\Theta_i;\ R\parallel=2f_y/\cos\Theta_i \quad (24)$$

The principal planes of the reflector 30 and 32 curvatures are aligned with those of the astigmatism and x and y can be interchanged in Equations (23) and (24) if needed.

I claim:

1. A broadband antenna system capable of correcting for astigmatism in a beam which is either radiated or received by the antenna system, the antenna comprising:

a main focusing reflector (10) arrangement;

a feed (12) comprising a predetermined aperture distribution and disposed to permit either one of the radiation of the beam in a particular direction and the reception of the beam from a particular direction along a feed axis of the antenna system; and astigmatic correction means (14) disposed to perform beam matching between the feed and the main focusing reflector arrangement for either the radiation or reception of the beam characterized in that the astigmatic correction means comprises:

a first reflector (16) disposed between the feed and the main focusing reflector arrangement along the feed axis of the antenna system for said beam, the first reflector comprising different focal lengths in each of two orthogonal planes equal to $1/f_1-1/L'_1+1/L'_i$ and a radius of curvature according to the relationships $$R_\perp = 2f_1(\perp)\cos\theta_i, \text{ and } R_\parallel = \frac{2f_1(\parallel)}{\cos\theta_i}$$

where $f_1$ is the focal length in each of the two orthogonal planes, $L'_1$ is the distance between the center of the first reflector and the center of the feed aperture distribution, $L'_1$ is the distance between the center of the first reflector and the center of an intermediate image of the feed formed by the first reflector, R || is the radius of curvature of said first reflector in the plane of incidence of said beam, R⊥ is the radius of curvature of said first reflector perpendicular to the plane of incidence, and $\Theta_i$ is the angle of incidence of the beam; and a second reflector (18) disposed between the first reflector and the main focusing reflector arrangement along the feed axis of the antenna system for said beam, the second reflector comprising different focal lengths in each of two orthogonal planes equal to $1/f_2=1/L_i+1/L_i$ and a radius of curvature according to the relationships $$R_\perp = 2f_2(\perp)\cos\theta_i, \text{ and } R_{\parallel} = \frac{2f_2(\parallel)}{\cos\theta_i}$$

where $f_2$ is the focal length in each of the two orthogonal planes, $L_1$ is the distance from the center of said second reflector to the center of a next reflector along the feed axis of the antenna system forming a part of the main focusing reflector arrangement, and $L_i$ is the distance between the center of the second reflector and said intermediate image of the feed formed by the first reflector, the first and second reflectors being spaced apart a distance, l, as determined from the relationship $$l = \frac{L'_1}{h}\left[\frac{L_1}{r_1} - 1\right] - hL_1\left(1 + \frac{L'_1}{r'_1}\right)$$

where $h=L'_1/L'_i \cdot L_i/L_1$, $r'_1$ is the radius of curvature of the phase distribution at the aperture of the feed, and $r_1$ is the radius of curvature of the phase distribution at a final image of the feed formed at said next reflector along the feed axis of the antenna system forming a part of the main focusing reflector arrangement.

2. A broadband antenna system according to claim 1 characterized in that where the intermediate image of the feed formed by the first reflector (16) of the astigmatic correction means is virtual and coincides with the feed aperture distribution in one of the two orthogonal planes, the first reflector of the astigmatic correction means comprises a reflecting surface corresponding to a portion of a cylinder with the flat radius of curvature being in the plane of coincidence between said intermediate image and feed aperture distribution.

3. A broadband antenna system according to claim 1 characterized in that where the intermediate image of the feed formed by the first reflector (16) of the astigmatic correction means is virtual and coincides with the reflecting surface of the next reflector along the feed axis of the antenna system forming a part of the main focusing reflector arrangement in one of the two orthogonal planes, the second reflector (18) of the astigmatic correction means comprises a reflector surface corresponding to a portion of a cylinder with the flat radius of curvature being in the plane of coincidence between said intermediate image and the reflecting surface of said next reflector along the feed axis of the antenna system.

4. A broadband astigmatic feed arrangement for use in an antenna system, the antenna system comprising a main focusing means (10), and the astigmatic feed arrangement comprising:

a feed (12) comprising a predetermined aperture distribution and disposed to permit either one of the radiation of the beam in a particular direction and the reception of the beam from a particular direction along a feed axis of the antenna system; and astigmatic correction means (14) disposed to perform beam matching between the feed and the main focusing means for either the radiation or reception of the beam characterized in that the astigmatic correction means comprises:

a first focusing means (30) disposed between the feed and the main focusing means (10) along the feed axis of the antenna system for said beam, the first focusing means comprising different focal lengths in each of two orthogonal planes equal to $1/f_1=1/L'_1=1/L'_i$ and a radius of curvature according to the relationships $$R_\perp = 2f_1(\perp)\cos\theta_i, \text{ and } R_{\parallel} = \frac{2f_1(\parallel)}{\cos\theta_i}$$

where $f_1$ is the focal length in each of the two orthogonal planes, $L'_1$ is the distance between the center of the first focusing means and the center of the feed aperture distributing, $L'_i$ is the distance between the center of the first focusing means and the center of an intermediate image of the feed formed by the first focusing means, R || is the radius of curvature of said first focusing means in the plane of incidence of said beam, R⊥ is the radius of curvature of said first focusing means perpendicular to the plane of incidence, and $\Theta_i$ is the angle of incidence of the beam; and a second focusing means (32) disposed between the first focusing means and the main focusing means along the feed axis of the antenna system for said beam, the second focusing means comprising different focal lengths in each of two orthogonal planes equal to $1/f_2=1/L_i+1/L_1$ and a radius of curvature according to the relationships $$R_\perp = 2f_2(\perp)\cos\theta_i, \text{ and } R_{\parallel} = \frac{2f_2(\parallel)}{\cos\theta_i}$$

where $f_2$ is the focal length in each of the two orthogonal planes, $L_1$ is the distance from the center of said second focusing means to the center of a next focusing means along the feed axis of the antenna system forming a part of the main focusing means, and $L_i$ is the distance between the center of the second focusing means and said intermediate image of the feed formed by the first focusing means, the first and second focusing means being spaced apart a distance, l, as determined from the relationship $$l = \frac{L'_1}{h}\left[\frac{L_1}{r_1} - 1\right] - hL_1\left(1 + \frac{L'_1}{r'_1}\right)$$

where $h = L'_1/L'_i \cdot L_i/L_1$, $r'$ is the radius of curvature of the phase distribution at the aperture of the feed and $r_1$ is the radius of curvature of the phase distribution at a final image of the feed formed at said next focusing means along the feed axis of the antenna system forming a part of the main focusing means.

5. A broadband astigmatic feed arrangement according to claim 4 characterized in that where the intermediate image of the feed formed by the first focusing means (30) of the astigmatic correction means is virtual and coincides with the feed aperture distribution in one of the two orthogonal planes, the first focusing means of the astigmatic correction means comprises a shape corresponding to a portion of a cylinder with the flat radius of curvature being in the plane of coincidence between said intermediate image and feed aperture distribution.

6. A broadband antenna system according to claim 4 characterized in that where the intermediate image of the feed formed by the first focusing means (30) of the astigmatic correction means is virtual and coincides with the surface configuration of the next focusing means along the feed axis of the antenna system forming a part of the main focusing means (10) in one of the two orthogonal planes, the second focusing means (32) of the astigmatic correction means comprises a shape corresponding to a portion of a cylinder with the flat radius of curvature being in the plane of coincidence between said intermediate image and the surface configuration of the next focusing means along the feed axis of the antenna system.

* * * * *

UNITED STATES PATENT AND TRADEMARK OFFICE

CERTIFICATE OF CORRECTION

PATENT NO. : 4,339,757

DATED : July 13, 1982

INVENTOR(S) : Ta-Shing Chu

It is certified that error appears in the above—identified patent and that said Letters Patent is hereby corrected as shown below:

Col. 6, Eq. (12) "- 1)" should read -- - 1)$^2$--. Col. 8, line 14 "$R_{|}$" should read --$R_{||}$--. Col. 8, Eq. (24) "$R_{\perp}$" should read --$R_{\perp}$--, and "R||" should read--$R_{||}$--. Col. 8, line 60, "-" should be --=--. Col. 9, line 4, "R||" should be --$R_{||}$--. Col. 9, line 6 "$R_{\perp}$" should read --$R_{\perp}$--. Col. 9, line 14 "$\frac{1}{L_i}$" should read --$\frac{1}{L_1}$--. Col. 10, line 23, the second "=" should be a --+--. Col. 10, line 36 "R||" should read --$R_{||}$--. Col. 10, line 38, "$R_{\perp}$" should read --$R_{\perp}$--. Col. 11, line 1, "r'" should read --$r'_1$--.

Signed and Sealed this

Twenty-ninth Day of May 1984

[SEAL]

Attest:

GERALD J. MOSSINGHOFF

Attesting Officer

Commissioner of Patents and Trademarks